United States Patent [19]

Simmons et al.

[11] Patent Number: 4,574,594

[45] Date of Patent: Mar. 11, 1986

[54] PORTABLE ICE TABLE WITH FRICTIONALLY ENGAGEABLE LEG LOCKING MECHANISM

[76] Inventors: Jesse K. Simmons; Maralyne J. Simmons, both of 4030 Sleeth Rd., Milford, Mich. 48042

[21] Appl. No.: 718,158

[22] Filed: Apr. 1, 1985

[51] Int. Cl.[4] ..... F25D 3/08

[52] U.S. Cl. ..... 62/457; 62/459

[58] Field of Search ..... 62/457, 371, 372, 530, 62/459, 462; 248/439

[56] References Cited

U.S. PATENT DOCUMENTS 4,375,758 3/1983 Simmons ..... 62/457

*Primary Examiner*—Lloyd L. King

*Attorney, Agent, or Firm*—Gifford, VanOphem, Sheridan & Sprinkle

[57] ABSTRACT

A portable ice table having a platform comprised of a light-weight material with an outer insulated surface and a removable insulating cover. The platform includes a handle, a recessed dry storage compartment and a recessed ice storage compartment separated from the dry storage compartment by a separating member. A threaded orifice is provided between the ice storage compartment and the side of the platform for storing and draining water from the ice table. The ice table further includes supporting members fixedly secured to the bottom of the platform for setting the platform on a table and also includes legs pivotably secured to the platform to support the platform above the ground or floor. The legs are provided with retractable locking rings which frictionally engage the supporting member to secure the leg into position.

25 Claims, 3 Drawing Figures

PORTABLE ICE TABLE WITH FRICTIONALLY ENGAGEABLE LEG LOCKING MECHANISM

BACKGROUND OF THE INVENTION

I. Field of the Invention

This invention relates to ice tables and, in particular, to a portable ice table for serving and preserving food which has a collapsible construction with leg locking members to facilitate storage and assembly of the device.

II. Description of the Prior Art

It is often desirable to serve food by setting it on tables and allowing an individual to select the particular items of food and the quantity desired. The serving of food in this manner has several advantages as it allows for several individuals to serve themselves at the same time. However, in order to keep food fresh and to prevent spoiling, the food may need to be stored on ice or a similar cooling material. Generally, the previously known ice tables are cumbersome because of the complex drainage and support structure and, thus, do not lend themselves to home use or transportation. These larger, previously known ice tables are utilized as permanent structures in restaurants and similar establishments which have sufficient space to store these tables.

Our previous U.S. Pat. No. 4,375,758 issues on Mar. 8, 1983 discloses a portable ice table for serving food which is compact, light-weight and portable and which has space for storing ice to cool food and drinks served from the table. The table generally comprises a platform made of a light-weight rigid plastic material having an outer insulating surface. The platform contains two recessed compartments, a dry storage compartment and an ice storage compartment, separated by a fixed or removable divider. The ice storage compartment has a first section for storing ice, a removable ice supporting member, and a second section which facilitates drainage of water from the melting ice. The second section includes a threaded orifice with a valve which extends through the side of the platform for draining water from the ice table.

The previous ice table further includes legs which are pivotably secured to the platform and may be locked into place by a hinged brace which extends from the leg to the platform. The hinged braces are the type found on conventional tables and are usually constructed of metal. Because the hinged brace must be unlocked prior to collapsing the leg, the brace is usually exposed for easy access. In addition to detracting from the aesthetic appearance of the table, these exposed braces also increase the risk of accidental collapse of one or more legs. This is particularly true at events where children may be apt to explore the structure of the ice table. Moreover, because these hinged braces depend upon pressure exerted in a particular direction, use of the table on uneven surfaces or after improper set-up may cause eventual collapse of the table.

SUMMARY OF THE PRESENT INVENTION

The present invention overcomes the disadvantages of the previously known ice tables and our portable ice table disclosed in U.S. Pat. No. 4,375,758 by providing a portable multi-compartment ice table which utilizes locking rings mounted on each leg and which frictionally engage the platform to lock the legs in position.

The portable ice table according to the present invention generally comprises a platform constructed of a light-weight plastic material which contains two recessed compartments, a dry storage compartment and an ice storage compartment which are separated by either a fixed or mutually removable dividing member. The recessed ice storage compartment has an upper ice storing section, a removable perforated ice supporting member, and a lower section disposed beneath the supporting member and the upper section. The lower section includes a threaded orifice which extends through the side of the platform for draining water from the ice table. As the ice stored in the upper section begins to melt, the water from the melted ice flows through openings in the perforated ice supporting member into the lower section. The bottom of the platform is sloped such that water flows towards the threaded orifice. A valve may be disposed within the orifice to control the flow of water through the orifice.

The present invention further includes legs which are pivotably secured to the platform and may be locked into place by the locking rings to support the platform above the floor or ground. If it is desired not to use the legs, the legs may be stored within the skirt of the platform and the platform may be placed on a table whereupon the platform rests on supporting members fixedly secured to the platform.

ood is placed upon the ice in the upper section of the ice storage compartment where it is kept cold while being served. A dry storage compartment is also provided for serving food which does not require chilling.

In accordance with the invention, the locking rings mounted to each of the legs frictionally engage the platform on the table to prevent the legs from pivoting into the closed position. The locking ring is provided with a series of ribs which facilitate handling of the ring. One side of the ring is squared which frictionally engages the support member of the platform. The opposing side is provided with a pair of grooves which engage a vertical rib on the outer surface of the recessed compartments. The inter-action of these grooves with the rib prevents the leg from pivoting out of position. In addition, because the locking ring is disposed behind the support member it is hidden from view and out of reach of the curious hands of children. Moreover, the frictional pressure caused by the engagement of the ring between the rib and support member, prevents accidental disengagement of the locking mechanism.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
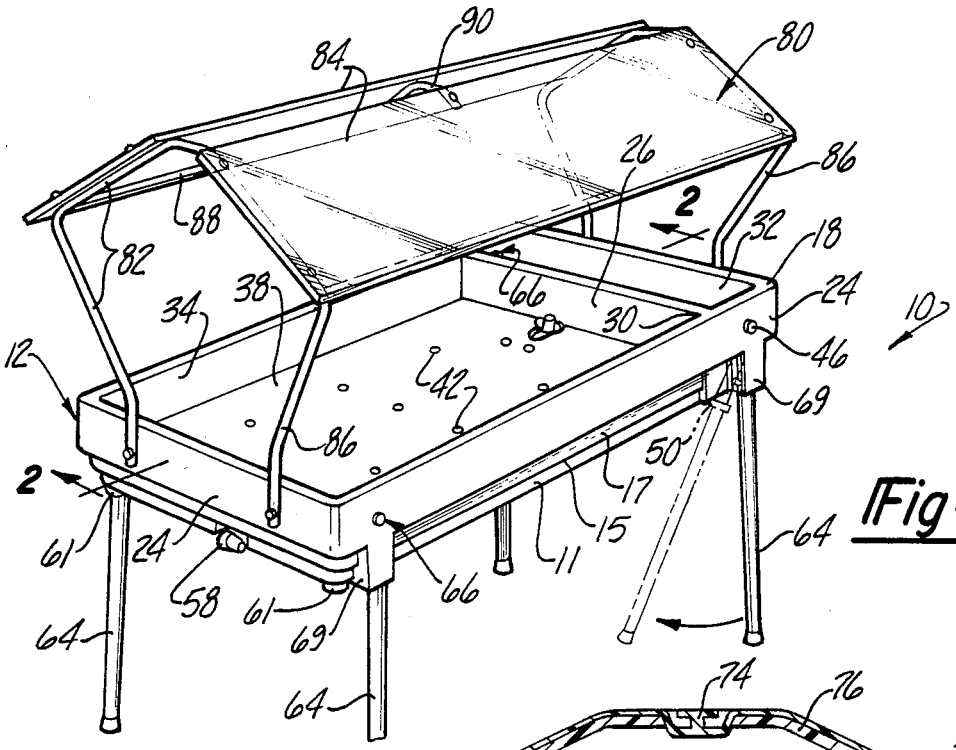
FIG. 1 is an elevated perspective of a preferred embodiment of the present invention.
Figure 2:
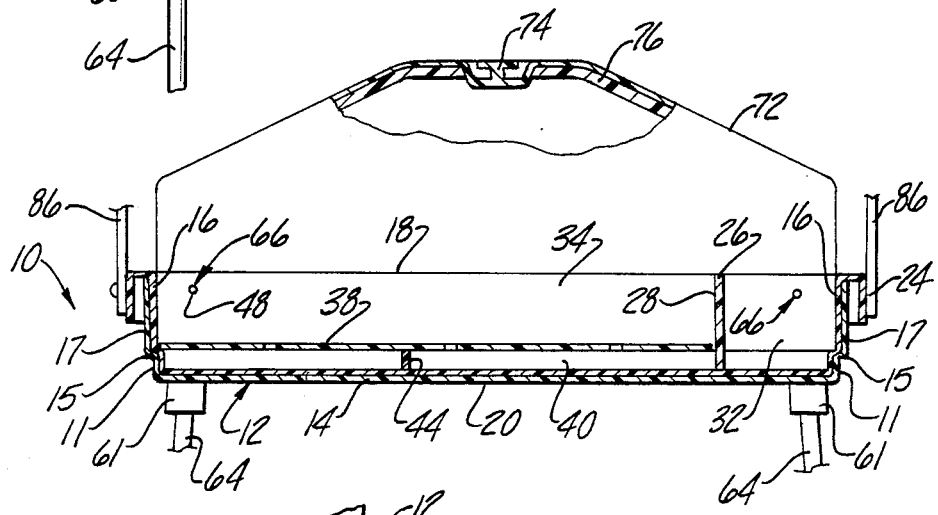
FIG. 2 is a longitudinal section of the present invention taken along line 2—2 of FIG. 1.

Referring generally to FIGS. 1 and 2 of the drawings, a portable ice table, collectively indicated by reference numeral 10, is comprised of a platform 12 comprised of a light-weight hard organic plastic material such as polyethylene or polypropylene, and having outer insulating surface 14 comprised of an expanded rigid polystyrene plastic such as Styrofoam.

Referring particularly to Fig. , the platform 12 includes a bottom 20, a lower vertical wall 11 extending upward from the bottom 20, a ledge 15 extending outward from the lower vertical wall 11, an upper vertical wall 17 extending upward from the ledge 15 and having an upper edge 18, and a skirt 24 depending from the upper edge 18 and spaced from the wall 17.

The plateform 12 also includes an inner surface 16 extending from the bottom 20 to the upper edge 18 of the upper vertical wall 17.

The platform 12 has a handle 22 for carrying and transporting the ice table 10.

The platform 12 further includes a manually removable separating member 26 extending vertically from the bottom 20 of the platform 12 to the upper edge 18 of the inner surface 16. The separating member 26 is fitted into and held in place by grooves 28 and 30 within the inner surface 16. In an alternate embodiment, the separating member 26 is non-removable and fixedly secured to the inner surface 16.

The platform 12 also includes a recessed dry storage compartment 32 and a recessed ice storage compartment 34 as shown in FIG. 2. The dry storage compartment 32 is separated from the ice storage compartment 34 by the separating member 26. The ice storage compartment 34 has an upper section 36 for storing ice, a manually removable perforated ice supporting member 38 and a lower section 40. The upper section 36 is disposed above the lower section 40 with the perforated ice supporting member 38 being disposed between the upper section 38 and the lower section 40.

The perforated ice supporting member 38 includes openings 42 between the upper section 36 and lower section 40. In its preferred construction is is comprised of a clear light-weight hard organic plastic material such as polyethylene or polypropylene which can be easily removed for cleaning. The ice supporting member 38 is positioned and supported between the upper section 36 and the lower section 40 by resting it on the ledge 15 and center positioning member 44. The center positioning member 44 is fixedly secured to and extends from the bottom 20 of the platform 12.

The second section 40 further includes a threaded orifice 58 which extends through the lower vertical wall 11 of the platform 12. A threaded valve stopper, hose or other similar device may be disposed within the threaded orifice 58 to control the opening and closing of the orifice 58.

The ice table 10 includes legs 64 to support the platform 12 above the floor or ground. The legs 64 are pivotably secured to the platform 12 by pins 66 having opposite ends 46 and 48. Ends 46 are secured to the upper vertical wall 17 with ends 48 secured to the skirt 24. The legs 64 include supporting positions where they are positioned in a direction which is generally vertical and normal to the platform 12.

Figure 3:
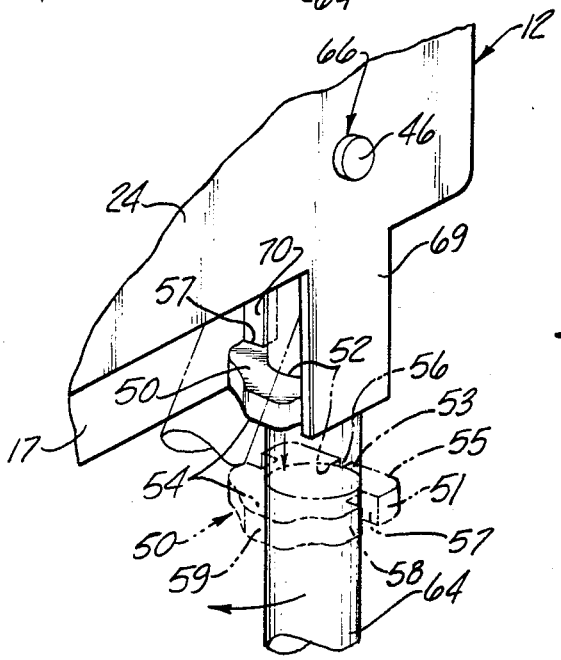
FIG. 3 is a detailed perspective of the leg locking assembly of the present invention.

The legs 64 are provided with locking rings 50 which encircle the legs 64 as shown in FIG. 3. The locking rings 50 provide vertical stability to the legs 64 and generally comprise a peripheral surface 51, which defines the outer configuration of the ring 50, and a throughbore 52 which is offset from the center of the ring 50 thereby defining a first thin wall 53, side walls 58 and a second thicker wall 54. The throughbore 52 defines the inner configuration of the ring 50 and may be any shape which conforms to the cross-sectional shape of the legs 64. In the embodiment shown in FIG. 3 the inner configuration of the ring 50 is round, although it may also be square or triangular.

As is shown in FIG. 3, the outer configuration of the locking ring 50 is substantially rectangular. Wall 53 has a planar outer surface 55 and a vertical slit 56 which allows expansion and contraction of the ring as will be hereinafter described. The walls 58 are provided with a pair of vertical grooves 57 which are formed parallel to the axis of the leg and throughbore. These grooves 57 secures the leg 64 in its proper position when the ring 50 is in the locking position as will be hereinafter described. Moreover, in the preferred embodiment, the thicker walls 54 of the ring 80 is provided with a flange portion 59 which facilitate gripping of the ring 50 during removal or placement.

When the legs 64 are in their non-supporting position they are stored within the platform 12 in the space 13 between the skirt 24 and the upper vertical wall 17 where they are held in place by clips 60 secured beneath the skirt 24 as shown in phantom line in FIG. 1. Alternatively, the legs 64 may be held in place within the platform 12 in the space 13 by the rings 50 frictionally engaging the skirt 24 and the vertical wall 17 or similar engaging members.

If the ice table 10 is to be used on a table top or like surface, the legs 64 are put in their non-supporting positions and the platform 12 is set on supporting members 61 which are fixedly secured to the platform 12 and which extend beneath the bottom 20 of the platform 12 as shown in FIG. 1 and 3.

As is best shown in FIG. 3, the vertical wall 17 is provided with a vertical rib 70 which engages the locking ring 50 in its upper locked position. Similarly, wall 69 is provided with a rib which also engages the locking ring. Since the inner configuration of the ring 50 conforms with the shape of the leg 64, the ring 50 may be easily moved up and down the leg 64 as desired. With the ring 50 in its lower position shown in phantom in FIG. 3, the leg 64 may be pivoted to its non-supporting or stored position. To secure the leg 64 in a supporting position, the leg 64 is extended perpendicular to the table 10 and the ring 50 is slid up the leg 64 such it frictionally engages the supporting member 61 and vertical wall 17. In its engaged position, the planar outer surface 55 of the ring 50 frictionally engages the inner surface of the support member 61 while wall 54 frictionally engages vertical wall 17. In addition, one of the grooves 57 engages the vertical rib 70 on wall 17 and wall 69 which prevents the ring 50 from disengaging and the legs 64 from inadvertently collapsing. Moreover, with the ring 50 in the engaging position, the pressure exerted by the support member 61, the vertical wall 17, and the rib 70, causes the ring 50 to contract thereby increasing the frictional engagement between the ring 50 and the leg 64. Alternatively, the upper portion of the leg 64 may be enlarged to increase the frictional contact between the ring 50 and the leg 64 thereby further preventing inadvertent disengagement.

The ice table 10 is used by placing the food to be kept chilled in the ice storage compartment 34 and food which is not required to be chilled in the dry storage compartment 32. While the food is being served, the ice in the upper section 36 of the ice storage compartment 34 begins to melt and water flows through the openings 42 of the ice supporting member 38 into the lower section 40.

The lower section 40 can be drained continuously by leaving the orifice 58 open for the entire use of the table 10. Alternatively, water can be stored in the lower section 40 by leaving the orifice 58 closed during the use of the ice table 10 and then draining the water from the lower section 40 by opening the orifice 58 when the use of the ice table 10 is no longer required.

The rigid polystyrene plastic provided in the outer surface 14 of the platform 12 maintains a cool temperature within the ice table 10 thereby slowing the melting process and preventing condensation.

The ice table 10 may also include a removable cover 72 comprised of a hard organic plastic such as polyethylene or polypropylene and includes a handle 74 as shown in FIG. 4. The cover has an inner insulating surface 76 which is comprised of an expanded rigid plastic such as Styrofoam. Alternatively, the cover 72 may be comprised of a reflective fabric which is held on the ice table by tension in an outer elastic band such as can be found on conventional table covers. The reflective fabric reflects heat from the sun thereby slowing the melting of the ice.

An additional accessory of the ice table 10 as shown in FIG. 1 and is generally known as a "sneeze" guard or hood guard 80. The hood guard 80 is demountably secured to the ends of the platform 12 and generally comprises a support structure 82 and at least one planar guard 84. The support structure 82 is preferably constructed of metal tubing and can be attached to the platform 12 to support the planar guard 84. The support structure comprises a pair of end frame members 86 and a plurality of lateral supports 88. The planar guards 84, which are preferably made of a transparent rigid plastic, are fixedly secured to the frame members 86 and lateral supports 88. Additional supports 90 may be included on hood guards 80 of greater length.

While the embodiment herein described calls for the ice table to be comprised of a hard organic plastic material, it would be apparent to one skilled in the art that the ice table may be constructed of a suitable alternate material such as wood or a light-weight metal.

Furthermore, it is to be understood that use of the locking ring 50 of the present invention is not limited to the cooling table 10 but may be incorporated into other collapsible tables. Although the locking ring is herein described as frictionally engaging the rib 70 and vertical wall 17, it should be understood that the locking ring 50 may be utilized on conventional tables by including a wall which extends downwardly from the outer edge of the table and has a vertical rib to frictionally engage only one side of the locking ring 50 and the grooves 57.

The foregoing detailed description has been given for clearness of understanding only and no unnecessary limitations should be understood therefrom as some modifications will be obvious to those skilled in the art to which it pertains without departing from the scope and spirit of the present invention as defined in the appended claims.

We claim:

1. A portable ice table comprising:

a platform having an outer insulating surface, a bottom, a vertical wall extending upward from said bottom and having an inner surface, and a dividing member with opposite ends secured to the inner surface and extending vertically from said bottom of said platform;

wherein said platform further includes a handle, a recessed dry storage compartment and a recessed ice storage compartment separated from said dry storage compartment by said dividing member and having an upper section for storing ice, a manually removable perforated ice supporting member and a lower section;

wherein said upper section is disposed above said lower section with said ice supporting member disposed therebetween;

wherein said ice supporting member includes a plurality of openings between said upper and lower sections;

wherein said lower section includes at least one positioning member to support said ice supporting member between said upper and lower section;

wherein said lower section includes means to store and drain water from said ice storage compartment;

a plurality of supporting members fixedly secured to said platform and extending downwardly therefrom; and a plurality of support legs pivotably secured to said platform wherein said support legs include a locking ring to lockingly engage said legs in a supporting or a non-supporting position, said locking ring comprising:

a substantially rectangular peripheral configuration with a planar front surface, a pair of side surfaces, and a rear surface having at least one groove disposed parallel to the axis of said locking ring; and a throughbore offset from the center of said locking ring wherein said throughbore conforms to the cross-sectional shape of said support leg.

2. The ice table as defined in claim 1 wherein said platform is comprised of a light-weight hard organic plastic material.

3. The ice table as defined in claims 1 or 2 wherein said outer insulating surface of said platform is comprised of an expanded rigid polystyrene plastic.

4. The ice table as defined in claim 1 wherein said means to store and drain water from said ice storage compartment comprises an orifice in said second section extending through said platform and includes means for opening and closing said orifice.

5. The ice table as defined in claim 4 wherein said orifice is threaded.

6. The ice table as defined in claim 4 wherein said means for opening and closing said orifice comprises a valve having open and closed positions disposed within said orifice.

7. The ice table as defined in claim 1 wherein the melting of ice stored in said upper section causes water to flow through said perforated ice supporting member into said lower section.

8. The ice table as defined in claim 6 wherein said bottom of said platform is sloped such that water flows away from said dry storage compartment towards said orifice.

9. The ice table as defined in claim 8 wherein the water received from the melting of the ice in said upper section is stored in said lower section when said orifice is closed.

10. The ice table as defined in claim 8 wherein the water received from the melting of the ice in said upper section is drained from said lower section when said orifice is open.

11. The ice table as defined in claim 1 and further comprising a removable insulating cover.

12. The ice table as defined in claim 1 wherein said platform includes a skirt around its perimeter depending from the upper edge of said inner surface and spaced from said vertical wall.

13. The ice table as defined in claim 12 wherein said legs are stored within said platform in the space between said skirt and said vertical wall when in said non-supporting positions.

14. The ice table as defined in claim 12 wherein said legs are positioned in a direction which is generally vertical and normal to said platform when in said supporting positions.

15. The ice table as defined in claim 13 wherein said fixedly secured supporting members support said platform above the generally horizontal surface when said support legs are in a non-supporting position.

16. The ice table as defined in claim 11 wherein said cover is comprised of a light-weight hard organic plastic material having a handle and including an inner insulating surface.

17. The ice table as defined in claim 16 wherein said inner insulating surface of said cover is comprised of an expanded rigid polystyrene plastic.

18. The ice table as defined in claim 11 wherein said cover is comprised of a light reflecting fabric with an elastic band secured to its edge.

19. The ice table as defined in claim 1 wherein said separating member is manually removable with opposite ends securable to said inner surface of said platform.

20. The ice table as defined in claim 1 and further comprising a hood guard demountably secured to said platform of said ice table whereby said hood guard shields the top of said platform from debris while allowing access to said dry and ice storage compartments.

21. The ice table as defined in claim 20 wherein said hood guard comprises a support structure and at least one rigid planar member fixedly secured to said support structure, said support structure demountably secured to said platform.

22. The ice table as defined in claim 21 wherein said rigid planar member is a transparent planar material.

23. The ice table as defined in claim 12 wherein said fixedly secured supporting members extend downwardly from said skirt.

24. The ice table as defined in claim 1 wherein said front planar surface of said locking ring frictionally engages said fixedly secured supporting member and wherein said rear surface of said locking ring frictionally engages said vertical wall of said platform.

25. The ice table as defined in claim 24 wherein said vertical wall of said platform includes a vertical rib and wherein said at least one groove of said rear surface engages said vertical rib whereby said support leg is prevented from pivoting from its supporting position.

* * * * *

UNITED STATES PATENT AND TRADEMARK OFFICE

CERTIFICATE OF CORRECTION

PATENT NO. : 4,574,594

DATED : March 11, 1986

INVENTOR(S) : Jesse K. Simmons and Maralyne J. Simmons

It is certified that error appears in the above--identified patent and that said Letters Patent are hereby corrected as shown below:

Column 2, line 4, change "mutually" to --manually--.

Column 4, line 23, change "80" to --50--.

Signed and Sealed this

Second Day of December, 1986

*Attest:*

DONALD J. QUIGG

*Attesting Officer*

*Commissioner of Patents and Trademarks*